US011555646B2

(12) United States Patent
Ries et al.

(10) Patent No.: US 11,555,646 B2
(45) Date of Patent: Jan. 17, 2023

(54) FREEZERS AND REFRIGERATORS

(71) Applicant: B Medical System S.A.R.L, Hosingen (LU)

(72) Inventors: Gilles Ries, Luxembourg (LU); Stephan Billen, Bitburg (DE)

(73) Assignee: B Medical Systems S.a.r.l., Hosingen (LU)

( * ) Notice: Subject to any disclaimer, the term of this patent is extended or adjusted under 35 U.S.C. 154(b) by 0 days.

(21) Appl. No.: 17/291,294

(22) PCT Filed: Nov. 5, 2019

(86) PCT No.: PCT/EP2019/080195
§ 371 (c)(1),
(2) Date: May 5, 2021

(87) PCT Pub. No.: WO2020/094619
PCT Pub. Date: May 14, 2020

(65) Prior Publication Data

US 2022/0003492 A1 Jan. 6, 2022

(30) Foreign Application Priority Data

Nov. 7, 2018 (GB) ..... 1818126

(51) Int. Cl.
*F25D 23/08* (2006.01)
*F25D 11/04* (2006.01)
*F25D 23/02* (2006.01)

(52) U.S. Cl.
CPC ..... *F25D 23/087* (2013.01); *F25D 11/04* (2013.01); *F25D 23/025* (2013.01)

(58) Field of Classification Search
CPC ..... F25D 23/087; F25D 11/04
See application file for complete search history.

(56) References Cited

U.S. PATENT DOCUMENTS 3,001,251 A 9/1961 Johnson
3,732,646 A 5/1973 Horvay
(Continued)

FOREIGN PATENT DOCUMENTS

CN 101251068 9/2008
CN 106639825 5/2017
(Continued)

OTHER PUBLICATIONS

International Search Report for corresponding PCT application PCT/EP2019/080195.
(Continued)

*Primary Examiner* — Daniel J Rohrhoff
(74) *Attorney, Agent, or Firm* — Jerold I. Schneider; Schneider IP Law

(57) ABSTRACT

A cold storage device, notably a freezer configured to operate at a temperature which is ≤−30° C., includes a door seal which comprises a single piece door seal, the single piece door seal comprising i) a sealing portion configured to provide a seal between the door and the door frame when the door is in its closed position and ii) a thermal insulating portion which, when the door is in its closed position, extends at least partially between inner periphery of the door frame and the outer periphery of the door frame.

20 Claims, 3 Drawing Sheets

(56) References Cited

U.S. PATENT DOCUMENTS

| | | | | |
|---|---|---|---|---|
| 3,803,274 | A | 4/1974 | Nakashima | |
| 8,910,950 | B2 * | 12/2014 | Deaver | B60J 10/80 49/303 |
| 2009/0113899 | A1 * | 5/2009 | Dain | F25D 23/062 62/48.1 |
| 2016/0178272 | A1 * | 6/2016 | Li | F25D 23/087 312/405 |
| 2017/0130522 | A1 * | 5/2017 | Lewan | E06B 3/4636 |
| 2017/0284143 | A1 | 10/2017 | Berchowitz | |
| 2018/0372396 | A1 * | 12/2018 | Willert | E06B 7/2309 |
| 2019/0011176 | A1 * | 1/2019 | Okada | F25D 23/02 |
| 2019/0383552 | A1 * | 12/2019 | Huang | B65D 88/12 |
| 2021/0123664 | A1 * | 4/2021 | Okada | F25D 23/025 |

FOREIGN PATENT DOCUMENTS

| | | |
|---|---|---|
| DE | 9103087 U | 7/1991 |
| JP | S60 89578 | 6/1985 |
| JP | 9-145235 | 6/1997 |
| JP | 2000283642 | 10/2000 |
| JP | 2003314953 | 11/2003 |
| JP | 2016-142449 | 8/2016 |
| JP | 2016-205597 A | 8/2016 |
| SU | 1 703 929 | 1/1992 |
| WO | 20070011124 | 1/2007 |

OTHER PUBLICATIONS

International Prelimnary Report on Patentability or corresponding PCT application PCT/EP2019/080195.

* cited by examiner

FREEZERS AND REFRIGERATORS

This invention relates to cold storage apparatus, notably freezers and refrigerators, particularly medical freezers and refrigerators, and more particularly to a door seal arrangement for such apparatus.

Freezers and refrigerators for medical or laboratory use, for example for storage of blood, blood products, vaccines and pharmaceuticals, require accurate control of the temperature of their cold storage compartments to ensure that any temperature variations remain within acceptable limits. This must be achieved whilst providing easy access to the cold storage compartment, low energy requirements and convenient manufacture, servicing and repair. Whilst existing designs address these issues, a need exists for improvements.

In accordance with one of its aspects, the present invention provides a cold storage device in accordance with claim 1. Other aspects are defined in independent claims. The dependent claims define preferred or alternative features.

Within the multiplicity of factors that contribute to the design of a freezer or refrigerator, part of the present invention lies in the realisation that a significant improvement can be achieved by focusing on the door seal. This is particularly the case for freezers operating at temperatures appropriate for medical freezers. It has been realised that, particularly in this case, an improved door seal arrangement may be used to mitigate issues caused by the combination of: i) the temperature difference between the cold storage compartment and the surroundings of the freezer and ii) the manufacturing tolerances which are inevitable for this type of apparatus. Thus, by providing for reduced heat loss across the door seal, notably in combination with reduced penetration of warm air, energy efficiency can be improved and issues related to formation of ice around the seal can be mitigated.

The cold storage device is preferably a freezer configured to operate with its cold storage compartment at a temperature which is ≤−30° C., notably ≤−40° C., ≤−50° C., ≤−60° C., ≤−70° C. or ≤−80° C. and/or ≥−120° C., ≥−100° C. or ≥−90° C. The improvement provided by the present invention is particularly notable at such operating temperatures; such freezers may be used for the cold storage of blood components, blood plasma, human cells, tissues and laboratory samples.

Alternatively, the cold storage device may be a freezer configured to operate with its cold storage compartment at a temperature which is ≤−15° C., notably ≤−20° C. or ≤−25° C. and/or ≥−50° C., ≥−45° C. or ≥−40° C.; such freezers may be used as laboratory freezers. Alternatively, the cold storage device may be a refrigerator configured to operate with its cold storage compartment at a temperature which is ≤18° C., notably ≤15° C. or ≤10° C. and/or ≥2° C., ≥4° C. or ≥5° C.; such refrigerators may be used as laboratory refrigerators, pharmacy refrigerators or medical refrigerators. The cold storage device may be configured to operate with:

a temperature of its surroundings which is anywhere in the range ≥5° C., ≥10° C. or ≥15° C. and/or ≤35° C., ≤30° C. or ≤26° C.; the temperature of the surroundings will typically be between about 15° C. and 26° C.; and/or a relative humidity of its surroundings which is anywhere in the range ≥30%, ≥40% or ≥50% and/or ≤90%, ≤80%, or ≤70%. Preferably, the cold storage device is configured to operate in surrounding in which the relative humidity is anywhere in the range ≥30% and ≤90%.

The door seal is thus primarily intended to minimise or prevent undesired ingress of warm and potentially humid air from the surroundings into the cold storage compartment when the door is in its closed position. The cold storage device is preferably configured to have a variation around the operating temperature of its cold storage compartment which is no more than: ±5° C.; ±3° C., ±2° C. or ±1.5° C.; the sealing arrangement facilitates obtaining such performance. The cold storage compartment may have volume which is ≥50 litres, ≥100 litres, ≥200 litres, ≥300 litres, ≥400 litres, ≥500 litres, ≥600 litres, ≥700 litres or ≥800 litres and/or ≤1500 litres, ≤1300 litres, ≤1200 litres or ≤1000 litres. The cold storage compartment may be selected from a cold storage compartment having a volume which is: ≥50 litres and ≤100 litres; ≥100 litres and ≤200 litres; ≥200 litres and ≤300 litres; ≥300 litres and ≤400 litres; ≥400 litres and ≤500 litres; ≥500 litres and ≤600 litres; ≥600 litres and ≤700 litres; ≥700 litres and ≤800 litres; ≥800 litres and ≤900 litres; ≥900 litres and ≤1000 litres; ≥1000 litres and ≤1500 litres. The door seal arrangement described herein is particularly suitable for such volumes.

Preferably, the cold storage device is an active cold storage device, that is to say, a cold storage device that comprises an electrically powered cooling circuit, notably including a compressor, to provide and maintain the desired temperature of its cold storage compartment.

In accordance with a further aspect, the present invention provides a range of cold storage devices, notable comprising cold storage devices selected from the aforementioned devices, each of which comprises a door seal as defined herein; this simplifies manufacture, maintenance and logistics by allowing a single form of door seal to be used over a range of devices.

As used herein the term cold storage compartment means a compartment, generally heat insulated, adapted to contain goods, for example blood, blood components, blood plasma, human cells, tissues, laboratory samples, at a cold storage temperature i.e. at a temperature below the temperature of the surroundings. As used herein, the term door means any type of moveable closure for the cold storage compartment; the door may be provided by a lid. Preferably, the door may be opened and closed by rotation about a substantially vertical axis or alternatively by rotation about a substantially horizontal axis, for example by means of hinges by which it is attached to the cold storage device. Alternatively, the door may be opened and closed by a linear movement, for example by sliding and/or by translation.

The door seal may be attached to a door seal support provided either as part of the door or part of the door frame. When the door is in its closed position, the seal preferably cooperates with and fits against a sealing face so as the provide the desired seal. The door seal support is preferably part of the door so that the door seal is attached to the door; in this case, a sealing face with which the door seal cooperates when the door is in its closed position is provided as part of the door frame. This configuration facilitates construction of the door frame and protection of the door seal. Alternatively, the door seal support may be part of the door frame so that the door seal is attached to the door frame; in this case, the sealing face with which the door seal cooperates when the door is in its closed position is provided as part of the door.

Particularly in the case of freezers and more particularly where the door opens and closes by rotation about a substantially vertical axis, a door handle and door latch mechanism may be provided to move the door from a partially closed to a fully closed position when closing the door and/or to retain the door in a fully closed position and/or to move the door from a fully closed position to a partially closed position when opening the door. In the fully closed position of the door the door seal is preferably compressed between the door and the door frame. The door handle and door latch mechanism preferably provide a mechanical advantage to facilitate closing and opening of the door. The door seal, notably the sealing portion(s) and the thermal insulating portions of the door seal, are preferably clamped between the door and the door frame when the door is in its fully closed position; this contributes to providing the desired level of sealing and thermal insulation. This clamping of the door seal is preferably provided by the door handle and door latch mechanism and is fundamentally different to door seal systems commonly used for example in domestic refrigerators which rely upon magnetic strips to maintain contact between a refrigerator door seal and a refrigerator door seal. Indeed, the door seals of the present invention preferably do not rely upon and more preferably do not comprise magnetic holding arrangements.

As used herein, the term "single piece door seal" means a door seal which is arranged as a single or unitary piece which can be handled as a single piece without separation of its constituent parts. All constituent parts of the single piece door seal are preferably permanently joined together; alternatively, individual parts of the single piece door seal may be capable of being disassembled and reassembled for use. Use of a single piece door seal facilitates assembly of the door seal both as original equipment as a replacement part and reduces the risk of assembly errors. Thus, in preferred embodiments, the door seal is a single piece door seal.

The sealing portion of the door seal preferably comprises a solid, resilient stop configured to completely fill a separation between the door and the door frame when the door is in its closed configuration. In preferred embodiments, the solid resilient stop is configured to be compressed between the door and the door frame when the door is in its closed configuration. The solid resilient stop is preferably configured with a level of hardness which provides a good seal whilst allowing a small amount of deformation when compressed between the door and the door frame.

The thermal insulating portion of the door seal preferably comprises a material having a thermal conductivity (when measured at 23° C.) which is ≤0.10 W/m·K, preferably ≤0.08 W/m·K and more preferably ≤0.07 W/m·K and/or which is ≥0.025 W/m·K; this provides good thermal insulation without the need of resorting to complex materials. The sealing portion of the door seal preferably comprises material having a thermal conductivity which is greater than that of the thermal insulating portion of the door seal, for example, which is at least twice or at least three time that of the thermal insulating portion of the door seal. This allows, in combination, the material of the sealing portion to be selected primarily for its mechanical and sealing properties whilst using the thermal insulating portion of the door seal to provide a majority of the desired heat insulation across the width of the door seal. The material of the sealing portion of the door seal may have a thermal conductivity (when measured at 23° C.) which is ≤0.45 W/m·K, preferably ≤0.40 W/m·K and more preferably ≤0.30 W/m·K and/or which is ≥0.12 W/m·K, preferably ≥0.15 W/m·K and more preferably ≥0.18 W/m·K; this avoids the sealing portion of the door seal creating too much of a thermal bridge.

The thermal insulating portion of the door seal may be provided by a foamed material and the sealing portion of the door seal may be provided by a non-foamed material. Preferably, all materials of the door seal are rated to have a working temperatures which are at least as low as −90° C. and at least as high as 30° C.; this allows the door seals to be used over a large range of cold storage devices. Preferred materials are non-foamed silicone rubber for the sealing portion and foamed silicone rubber for the thermal insulating portion. In preferred embodiments, the use a non-foamed material for the sealing portion and the use of a foamed version of the same material for the thermal insulating portion facilitates compatibility between the portions and facilitates manufacture.

In one preferred embodiment, the sealing portion comprises:

an outer sealing portion configured, when the door is in its closed position, to provide a seal between the door and the door frame at a position adjacent to the outer periphery of the door frame and an inner sealing portion configured, when the door is in its closed position, to create a seal between the door and the door frame adjacent to the inner periphery of the door frame, and the thermal insulating portion is positioned between the inner sealing portion and the outer sealing portion.

This provides a double seal across the width of the sealing face, protects the thermal insulation portion between the inner sealing portion and the outer sealing portion and provides mechanical stability for the door seal.

Particularly where the thermal insulating portion is provided by a foamed material, a material having greater resistance to damage, notably having a greater tear strength, may cover the thermal insulating portion to provide a resistant, exposed surface. This may be used to reduce the risk of damage to the thermal insulating portion, for example if the door seal is pulled away from ice which has formed at the door frame.

The thermal insulating portion is preferably provided as a core of the door seal having its entire periphery surrounded by a sleeve, notably a sleeve which provides the sealing portion; the sleeve preferably provides mechanical protection for the core and provides, at least in part, for the integrity of the core and sleeve as a single piece door seal. Particularly in this case, coextrusion of the core and the sleeve provides a particularly convenient manufacturing technique. It may be advantageous to provide a separate adhesive between the thermal insulating portion and the sealing portion to provide or contribute to integrity between these two portions. Such an adhesive may help to compensate for a temperature difference between the manufacturing temperature of the door seal and its temperature in use, and/or compensate for differences in temperature between different portions of the door seal when in use. Where the thermal insulating portion is provided as a core of the door seal having its entire periphery surrounded by a sleeve and an additional adhesive is provided between the core and the sleeve, this additional adhesive is preferably provided between the core and a base of the sleeve; in this case, it is preferred that no additional adhesive is provided between the core and a top portion of the sleeve. Such a configuration helps to avoid the risk of waves or deformations at the top surface of the sleeve which would be unsightly and potentially interfere with the sealing function.

In a preferred embodiment, the sealing portion comprises a deformable lip configured to resiliently deform to contribute to provision of a seal when the door is moved from its open position to its closed position. This provides a useful contribution to the sealing effect, particularly in hindering ingress of air to the cold storage compartment from its surroundings and thus mitigating against condensation of water vapour from such air and potential freezing of such condensation at the door seal. The sealing portion may comprise a pair of spaced deformable lip each of which is configured to resiliently deform to contribute to provision of a seal when the door is moved from its open position to its closed position. The provision of a pair of spaced lips facilitates an even application of pressure to the door seal when the door it closed and thus helps to avoid deformation or twisting of the door seal which could hinder its sealing function.

The base of the single piece door seal may comprises a resilient base lip configured to contribute to providing a seal between the base of the door seal and the door seal support; this further enhances the sealing function, notably by hindering ingress of air to the cold storage compartment from its surroundings. An arrangement in which the base lip comprises arms which wrap around an edge of the door seal support may be used to achieve this in a convenient way.

The single piece door seal may be fabricated into a continuous closed band door seal, for example a continuous closed rectangular band having four linear strips of the door seal, each end of which is joined to an end of an adjacent linear strip of the door seal, notably at a corner joint. The corner joint may be produced by arranging the ends of two linear strips in a mound and injecting material in to the mound to produce a continuous joint comprising the end of each strip of door seal. This is a particularly advantageous fabrication method when the door seal is extruded as it allows individual lengths of door seal to be joined together to form a variety of sizes of continuous closed band door seal whilst providing a continuous joint at the joints or corner sections. Preferably, the injected material used to form the joint is the same material as the material of the sealing portion of the door seal, notably a silicone rubber, preferably a silicon rubber of the same composition.

Where a sealing face, against which the door seal is positioned when the door is in its closed position, comprises one or more joints, for example at or adjacent to corner portions, notably to cooperate with a respective corner joint of the door seal, the corner portion of the sealing face preferably comprises a continuous sealing face portion which cooperates with its respective corner joint of the door seal and a connection between the continuous sealing face portion and an adjacent portion of the sealing face, with the position of the connection being offset around the periphery of the sealing face with respect to the position of the corner joint of the door seal. Arranging for a corner joint of the door seal and a corner joint of the sealing face to be offset from one another helps to ensure a desired level of seal and avoids potential manufacturing tolerances of the corner joint of the door seal and potential manufacturing tolerances of the corner joint of the sealing face coinciding at the same place and thus potentially deteriorating the sealing function.

The door seal preferably comprises a door seal attachment at its base by which it may be secured to a door seal support. The door seal attachment may be provided by one or more projections from the base of the door seal and/or one or more recesses in the door seal which preferably provide a press-fit attachment with the door seal support. The door seal attachment is preferably resilient and self-locking; this facilitates assembly. In preferred embodiments it allows removal of the door seal from the door seal support by pulling away of a door seal to be replaced and a push fit of a replacement door seal; this facilitates maintenance.

The door seal may be symmetrical about a central axis, notable an axis perpendicular to its base. This helps to avoid undesired deformation during manufacture and undesired twisting or deformation in use.

The door seal may have:

a width which is ≥15 mm or ≥20 mm and/or ≤80 mm or ≤60 mm; and/or a height which, when the door is in its closed position, completely fills a separation between the door and the door frame which is ≥5 mm or ≥8 mm and/or ≤25 mm or ≤20 mm.

The thermal insulating portion may have:

a width which is ≥10 mm or ≥15 mm and/or ≤70 mm, ≤50 mm or ≤35 mm; and/or a height which, when the door is in its closed position, completely fills a separation between the door and the door frame which is ≥3 mm or ≥5 mm and/or ≤15 mm or ≤10 mm.

Preferably, the thermal insulating portion makes up:

at least 50% and preferably at least 65% of the width of the door seal as measured across the shortest width between the inner and outer periphery of the door frame; and/or at least 40% and preferably at least 50% or at least 60% of the height of the door seal when the door is in its closed position as measured across the shortest height between the door and the door frame.

In accordance with a further aspect, the present invention provides a cold storage device, notably a freezer configured to operate at a temperature which is ≤−30° C., the cold storage device comprising:

at least one cold storage compartment;

a door which is openable to provide access to the cold storage compartment and closable to isolate the cold storage compartment from the surroundings of the cold storage device;

a door frame against which the door fits when the door is in its closed position, the door frame having an inner periphery adjacent to the cold storage compartment and an outer periphery adjacent to the exterior of the cold storage device; and a door seal positioned between the door frame and the door when the door is in its closed position, the door seal comprising a base by which it is attached to a door seal support provided either as part of the door or part of the door frame and a door seal sealing face which is exposed when the door it in its open position and which provides a seal against a frame sealing surface when the door is in its closed position; characterised in that the frame sealing face comprises a discontinuous surface comprising a frame sealing face joint;

the door seal comprises a door seal joint between two door seal portions; and the position of the frame sealing face joint is offset around a periphery of the frame sealing face with respect to the position of the door seal joint.

In a preferred arrangement, the door seal joint is provided at a corner joint of the door seal and the frame sealing face joint is offset from a corner of frame sealing face. The frame sealing face may be provided with a corner section having a continuous sealing face which extends around a corner; in this case, the continuous frame sealing face of the corner section may be juxtapositioned with an adjacent frame sealing face or an adjacent portion of the sealing face at a position which is spaced from the corner.

An embodiment of the invention will now be described, by way of example only, with reference to the accompanying drawings, of which:

Figure 1:
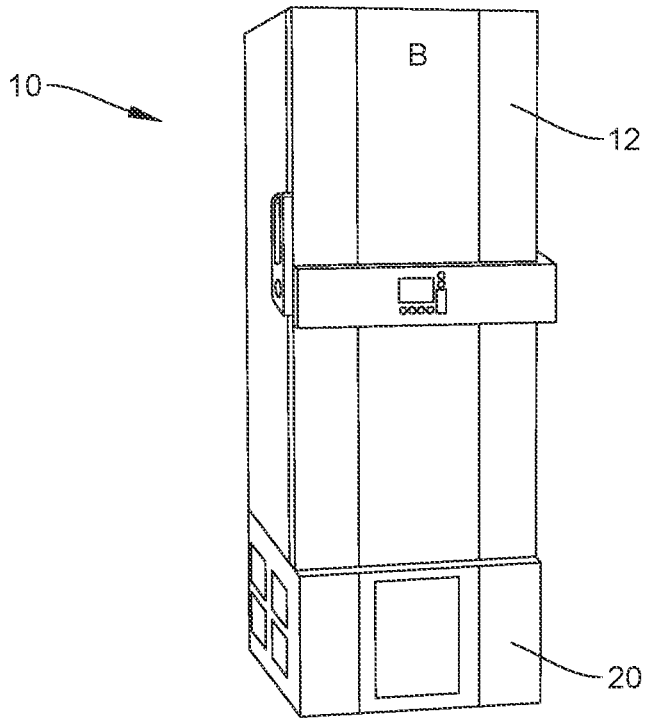
FIG. 1 is a schematic perspective view of a freezer with its door closed.
Figure 2:
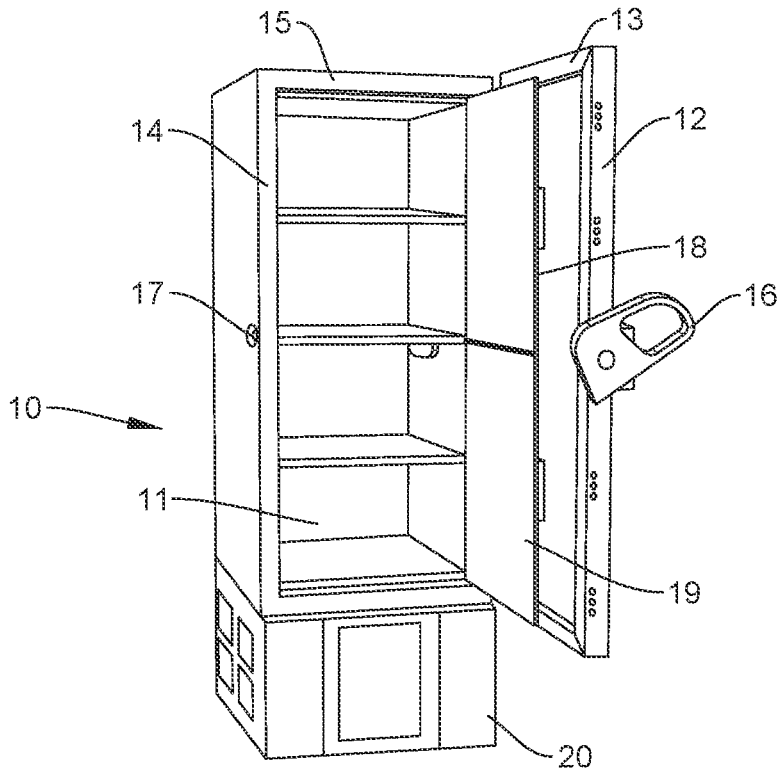
FIG. 2 is a schematic perspective view of a freezer with its door open.

The cold storage device 10 of FIG. 1 and FIG. 2 is a medical freezer having a heat insulated cold storage compartment 11 which in this example is divided by shelves in to four horizontal sub-compartments. The freezer 10 has a door 12 which is openable to provide access to the cold storage compartment 11 and closable to isolate the cold storage compartment for its surroundings. A door seal 13 runs around a periphery of the door 12 and, when the door is closed, contacts and seals against a frame sealing face 14 of a door frame 15 of the freezer. A door handle 16 and door latch 17 cooperate to retain the door in its closed position and, in the closed position of the door, to compress the door seal 13 against the frame sealing face 14.

The illustrated freezer 10 is configured to operate with its cold storage compartment at a temperature of about −80° C.; it is particularly suitable for the storage of blood products, for example plasma. It is provided with hinged, internal upper 18 and lower 19 compartment closures which allow independent access to upper and lower portion of the cold storage compartment 11 when the door 16 is open. The freezer 10 has an electrically powered compressor (not shown) arranged in its base 20 as part its cooling circuit.

Figure 3:
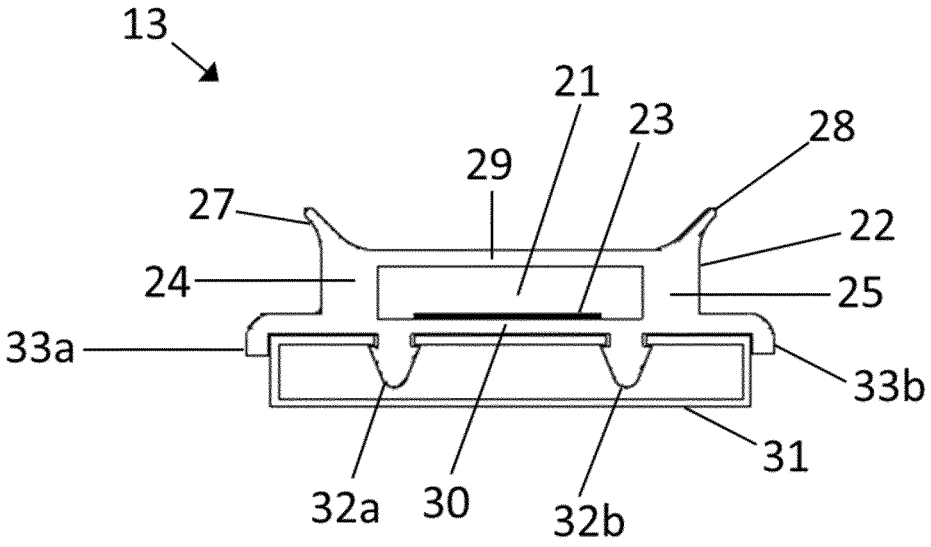
FIG. 3 is a schematic cross section through a door seal.

The door seal 13 is illustrated in more deal in FIG. 3 and comprises a foamed silicone rubber thermal insulating portion 21 provided in the form of a core and a non-foamed silicone rubber sealing portion 22 provided by a sleeve which, in this example, entirely surrounds a periphery of the thermal insulating core 21. It is manufactured by co-extrusion in continuous lengths. The foamed silicone rubber thermal insulating material 21 has a thermal conductivity of about 0.058 W/m·K when measured at 23° C.; the non-foamed silicone rubber material has a thermal conductivity of about 0.22 W/m·K when measured at 23° C. An additional adhesive 23 is preferably provided between the core 21 and a base of the sleeve. The door seal 13 is a single piece door seal, the thermal insulation core 21 and the sealing portion 22 forming an integral assembly which can be handled as a single piece.

The sealing portion 22 comprises:

an outer sealing portion 24 which, when the door 12 is in its closed position, provides a seal between the door 12 and the sealing face 14 of the door frame 15 at a position adjacent to an outer periphery of the door frame 15 and an inner sealing portion 25 which, when the door 12 is in its closed position, provides a seal between the door 12 and the sealing face 14 of the door frame 15 adjacent to the inner periphery of the door frame.

The outer sealing portion 24, or at least its exposed side surface, will be at a temperature close to the temperature of the surroundings, for example room temperature or about 20° C., whilst the inner sealing portion 25 or at least its exposed side surface, will be at a temperature close to the temperature of the cold storage compartment, for example about −80° C. The thermal insulating portion 21 positioned between the inner sealing portion 25 and the outer sealing portion 24 thus reduces the heat loss across the width of the door seal 13.

Each of the outer 24 and inner 25 sealing portions comprises a solid, resilient stop which completely fills the separation between the door 12 and the sealing face 14 when the door is in its closed configuration and is compressed between the door 12 and the sealing face 14 by action of the door handle 16 and door latch 17. Each of the outer 24 and inner 25 sealing portions comprises a flexible, deformable lip 27, 28 which contributes to providing a seal. A bridging portion 29 of the sealing portion 22 covers an upper portion of the thermal insulation portion 21 between the outer 24 and inner 25 sealing portions; the bridging portion 29 has a thickness which provides physical protection for the foam core 21 without being significantly detrimental to thermal conduction.

A base 30 of the door seal which, in the illustrated embodiment, is contiguous with the extruded sealing portion 22, sits on a door seal support 31 which is part of the door 12 and is connected thereto by a pair of spaced projections 32*a*, 32*b* which form door seal attachments. These are extruded strips which form part of the sleeve and provide a resilient, self-locking press-fit and pull release with corresponding openings in the door seal support. The base 30 of door seal 13 also comprises a resilient outer 33*a* and inner 33*b* door seal support lip which contribute to providing a seal between the door seal 13 and the door seal support 31, each of which comprises a projection in the form of an arm which wraps around an edge of the door seal support 31.

Figure 4:
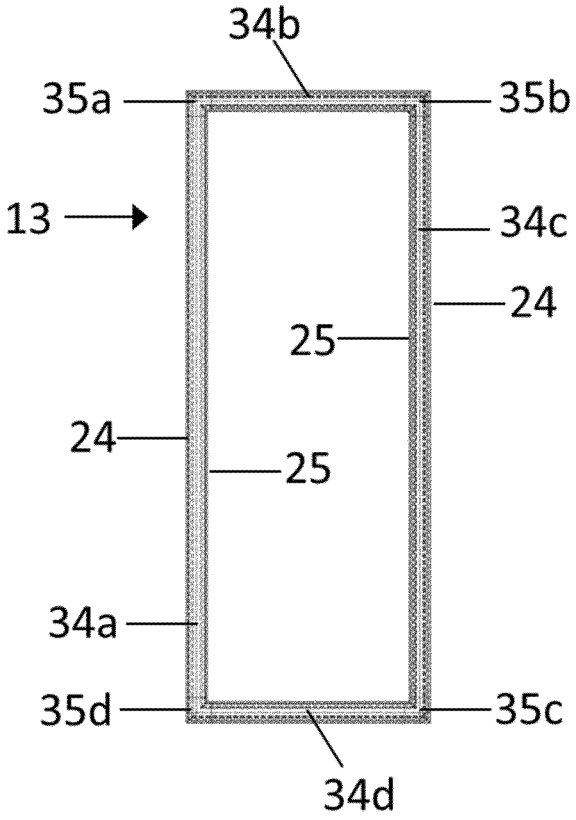
FIG. 4 is a plan view of a closed door seal band.

As illustrated in FIG. 4, the door seal 13 is fabricated into a continuous closed band having a geometry corresponding to that of the periphery of the door 12. In the illustrated embodiment, a continuous rectangular band is formed from four discrete lengths of door seal 34*a*, 34*b*, 34*c*, 34*d*, respective ends of which are cut, for example at 45° angles, arranged in a mould and joined together by injection of non-foamed silicone rubber to form respective corner joints 35*a*, 35*b*, 35*c*, 35*d* of the door seal band. The joint between individual lengths of the door seal is positioned at a respective corner of the rectangular band.

Figure 5:
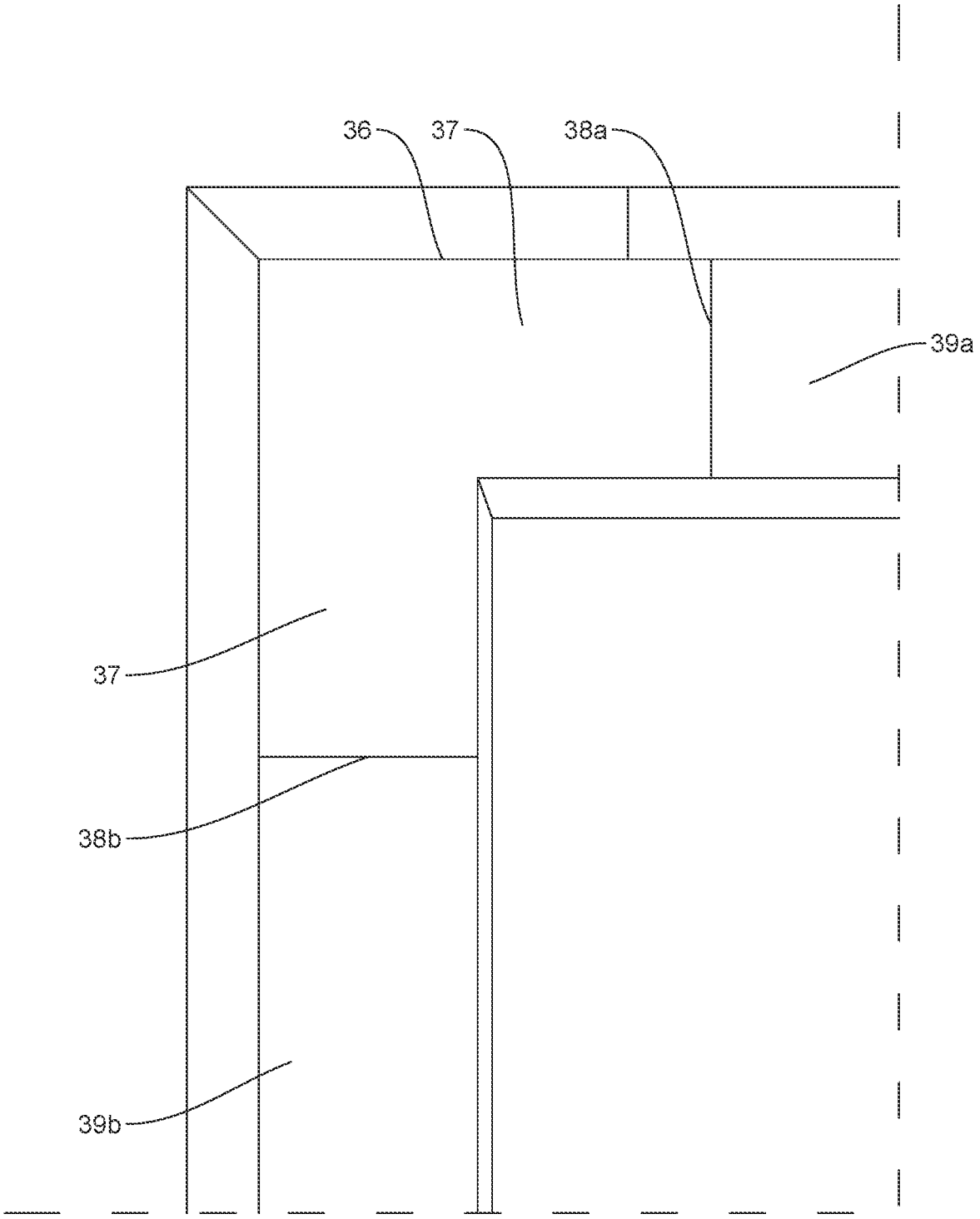
FIG. 5 is a schematic perspective view of a corner portion of a frame sealing face.

FIG. 5 illustrates a corner portion of the frame sealing surface 14 against which the door seal sits when the door is in its closed position. A corner section 36 of the frame sealing surface 14 is provided with a continuous, uninterrupted sealing face 37 which extends around the corner. Joints 38*a*, 38*b* between the sealing face 37 of the corner section 36 and adjacent portions 39*a*, 39*b* of the frame sealing face are spaced away from the corner. In this way, the positions of the frame sealing face joints 38*a*, 38*b* is offset around a periphery of the frame sealing face 14 with respect to the position of the door seal joint.

LIST OF REFERENCE NUMBERS

10 medical freezer
11 cold storage compartment
12 door
13 door seal
14 frame sealing face
15 door frame
16 door handle
17 door latch
18 upper compartment closure
19 lower compartment closure
20 base of freezer
21 thermal insulation portion
22 sealing portion
23 additional adhesive
24 outer sealing portion
26 inner sealing portion
27 lip
28 lip
29 bridging portion
30 base of door seal
31 door seal support
32*a* attachment

32*b* attachment
33*a* outer door seal support lip
33*b* inner door seal support lip
34*a* discrete length of door seal
34*b* discrete length of door seal
34*c* discrete length of door seal
34*d* discrete length of door seal
35*a* corner joint of door seal
35*b* corner joint of door seal
35*c* corner joint of door seal
35*d* corner joint of door seal
36 corner section of the sealing surface
37 continuous sealing face
38*a* joint
38*b* joint
39*a* adjacent portion of the sealing surface
39*b* adjacent portion of the sealing surface

The invention claimed is:

1. A cold storage device, comprising:

a cold storage compartment;

a door which is openable to provide access to the cold storage compartment and closable to isolate the cold storage compartment from the surroundings of the cold storage device;

a door frame against which the door fits when the door is in its closed position, the door frame having an inner periphery adjacent to the cold storage compartment and an outer periphery adjacent to the exterior of the cold storage device;

a door seal positioned between the door frame and the door when the door is in its closed position; and;

a door handle and door latch mechanism configured to move the door from a partially closed to a fully closed position when closing the door and to retain the door in a fully closed position in which the door seal is compressed between the door and the door frame;

wherein the door seal comprises a single piece door seal, the single piece door seal comprising i) a sealing portion configured to provide a seal between the door and the door frame when the door is in its closed position, the sealing portion of the door seal comprising a solid, resilient stop configured to completely fill a separation between the door and the door frame when the door is in its closed configuration, and ii) a thermal insulating portion which, when the door is in its closed position, extends at least partially between the inner periphery of the door frame and the outer periphery of the door frame;

and wherein the thermal insulating portion is provided in the form of a core of the door seal; and the sealing portion is provided by a portion of a sleeve which surrounds an entire periphery of the core.

2. The cold storage device of claim 1, wherein the cold storage device is freezer compartment configured to operate at a temperature which is ≤−30° C.

3. The cold storage device of claim 1, wherein the solid resilient stop is configured to be compressed between the door and the door frame when the door is in its closed configuration.

4. The cold storage device of claim 1, wherein the sealing portion comprises an outer sealing portion configured, when the door is in its closed position, to provide a seal between the door and the door frame at a position adjacent to the outer periphery of the door frame and an inner sealing portion configured, when the door is in its closed position, to provide a seal between the door and the door frame at a position adjacent to the inner periphery of the door frame, and in which the thermal insulating portion is positioned between the inner sealing portion and the outer sealing portion.

5. The cold storage device of claim 1, wherein the thermal insulating portion comprises a foamed material and the sealing portion comprises a non-foamed material.

6. The cold storage device of claim 5, wherein the thermal insulating portion comprises a silicone rubber foam and the sealing portion comprises a silicone rubber.

7. The cold storage device of claim 1, wherein the core and the sleeve are coextruded.

8. The cold storage device of claim 1, wherein a separate adhesive is provided between a base of the core and a base of the sleeve.

9. The cold storage device of claim 1, wherein the sealing portion of the single piece door seal comprises a deformable lip configured to resiliently deform to contribute to provision of a seal when the door is moved from its open position to its closed position.

10. The cold storage device of claim 1, wherein the cold storage device is selected from a freezer, a medical freezer, a refrigerator and a medical refrigerator.

11. A cold storage device, comprising:

a cold storage compartment;

a door which is openable to provide access to the cold storage compartment and closable to isolate the cold storage compartment from the surroundings of the cold storage device;

a door frame against which the door fits when the door is in its closed position, the door frame having an inner periphery adjacent to the cold storage compartment and an outer periphery adjacent to the exterior of the cold storage device;

a door seal positioned between the door frame and the door when the door is in its closed position; and;

a door handle and door latch mechanism configured to move the door from a partially closed to a fully closed position when closing the door and to retain the door in a fully closed position in which the door seal is compressed between the door and the door frame;

wherein the door seal comprises a single piece door seal, the single piece door seal comprising i) a sealing portion configured to provide a seal between the door and the door frame when the door is in its closed position, the sealing portion of the door seal comprising a solid, resilient stop configured to completely fill a separation between the door and the door frame when the door is in its closed configuration, and ii) a thermal insulating portion which, when the door is in its closed position, extends at least partially between the inner periphery of the door frame and the outer periphery of the door frame;

The cold storage device of claim 1, wherein the door seal is attached to a door seal support and the single piece door seal comprises a resilient door seal support lip configured to contribute to providing a seal between the door seal and a door seal support; and;

wherein the door seal support lip comprises a portion which wraps around an edge of the door seal support.

12. The cold storage device of claim 11, wherein the cold storage device is freezer compartment configured to operate at a temperature which is ≤−30° C.

13. The cold storage device of claim 11, wherein the solid resilient stop is configured to be compressed between the door and the door frame when the door is in its closed configuration, and wherein the sealing portion comprises an outer sealing portion configured, when the door is in its closed position, to provide a seal between the door and the door frame at a position adjacent to the outer periphery of the door frame and an inner sealing portion configured, when the door is in its closed position, to provide a seal between the door and the door frame at a position adjacent to the inner periphery of the door frame, and in which the thermal insulating portion is positioned between the inner sealing portion and the outer sealing portion.

14. The cold storage device of claim 11, wherein the thermal insulating portion comprises a foamed material and the sealing portion comprises a non-foamed material.

15. The cold storage device of claim 11, wherein the thermal insulating portion is provided in the form of a core of the door seal; and the sealing portion is provided by a portion of a sleeve which surrounds an entire periphery of the core.

16. A cold storage device, comprising:

a cold storage compartment;

a door which is openable to provide access to the cold storage compartment and closable to isolate the cold storage compartment from the surroundings of the cold storage device;

a door frame against which the door fits when the door is in its closed position, the door frame having an inner periphery adjacent to the cold storage compartment and an outer periphery adjacent to the exterior of the cold storage device;

a door seal positioned between the door frame and the door when the door is in its closed position; and;

a door handle and door latch mechanism configured to move the door from a partially closed to a fully closed position when closing the door and to retain the door in a fully closed position in which the door seal is compressed between the door and the door frame;

wherein the door seal comprises a single piece door seal, the single piece door seal comprising i) a sealing portion configured to provide a seal between the door and the door frame when the door is in its closed position, the sealing portion of the door seal comprising a solid, resilient stop configured to completely fill a separation between the door and the door frame when the door is in its closed configuration, and ii) a thermal insulating portion which, when the door is in its closed position, extends at least partially between the inner periphery of the door frame and the outer periphery of the door frame;

wherein the single piece door seal comprises a continuous, closed, rectangular band having four straight lengths and four corner joints; and;

wherein when the door is in its closed position, the door seal seals against a sealing face which comprises four sealing face corner portions, each of which cooperates with a respective corner joint of the door seal, each sealing face corner portion comprising a continuous sealing face portion which cooperates with its respective corner joint of the door seal and an abutment with an adjacent portion of the sealing face, the position of the abutment being offset around the periphery of the sealing face with respect to the position of the corner joint of the door seal.

17. The cold storage device of claim 16, wherein the cold storage device is freezer compartment configured to operate at a temperature which is ≤−30° C.

18. The cold storage device of claim 16, wherein the solid resilient stop is configured to be compressed between the door and the door frame when the door is in its closed configuration, and wherein the sealing portion comprises an outer sealing portion configured, when the door is in its closed position, to provide a seal between the door and the door frame at a position adjacent to the outer periphery of the door frame and an inner sealing portion configured, when the door is in its closed position, to provide a seal between the door and the door frame at a position adjacent to the inner periphery of the door frame, and in which the thermal insulating portion is positioned between the inner sealing portion and the outer sealing portion.

19. The cold storage device of claim 16, wherein the thermal insulating portion comprises a foamed material and the sealing portion comprises a non-foamed material.

20. The cold storage device of claim 16, wherein the thermal insulating portion is provided in the form of a core of the door seal; and the sealing portion is provided by a portion of a sleeve which surrounds an entire periphery of the core.

* * * * *